US005652976A

United States Patent [19]

Hopper

[11] Patent Number: 5,652,976

[45] Date of Patent: Aug. 5, 1997

[54] PREFABRICATED MODULAR INVALID BATHROOM UNIT

[76] Inventor: Clair L. Hopper, 5555 Glass Rd., Pittsburgh, Pa. 15205

[21] Appl. No.: 679,299

[22] Filed: Jul. 12, 1996

[51] Int. Cl.[6] ..... A47K 4/00

[52] U.S. Cl. ..... 4/664; 4/604; 4/670; 4/663

[58] Field of Search ..... 4/604, 670, 663, 4/664, 665

[56] References Cited

U.S. PATENT DOCUMENTS

| | | | |
|---|---|---|---|
| 2,087,121 | 7/1937 | Samelow | 4/663 |
| 2,907,048 | 10/1959 | Gould | 4/2 |
| 3,047,106 | 7/1962 | Callahan | 4/670 |
| 3,162,863 | 12/1964 | Wokas | 4/670 |
| 3,533,200 | 10/1970 | Zoebelein | 4/663 |
| 3,905,048 | 9/1975 | Moller | 4/2 |
| 4,142,255 | 3/1979 | Togni | 4/670 |
| 4,238,858 | 12/1980 | Maihart | 4/546 |
| 4,680,817 | 7/1987 | Sloan et al. | 4/663 |
| 4,899,402 | 2/1990 | Maynard et al. | 4/663 |
| 5,065,462 | 11/1991 | Romano | 4/604 |

*Primary Examiner*—David J. Walczak

*Attorney, Agent, or Firm*—Carothers & Carothers

[57] ABSTRACT

A prefabricated modular invalid bathroom unit for installation in a room which has a shower seat portion with a shower seat, a shower floor portion adjacent the shower seat portion for draining shower water, an upper shower wall portion detachably mounted on the shower seat portion which performs as a back-splash surround opposite the shower floor portion, and a commode portion for receiving a water closet which is joinable with the shower floor on the opposite side from the shower seat. The shower floor is provided with a door opening for wheelchair access. Water supply pipes and water drain pipes are carried by the shower unit and connected together between modular portions with conventional plumbing connectors, couplers and fittings. Each modular portion is sufficiently short in height to pass through a standard door opening for easy access into the invalid's home and respective rooms of the home. A combination foundation seat and plumbing template is also provided for securement to the room floor for receiving and retaining the assembled bathroom unit thereon and for also providing a plumbing template which prelocates all plumbing access holes which must be provided in the underlying floor for the bathroom unit prior to assembly.

22 Claims, 4 Drawing Sheets

PREFABRICATED MODULAR INVALID BATHROOM UNIT

BACKGROUND OF THE INVENTION

This invention relates generally to bathroom facilities, and more particularly to prefabricated and preplumbed invalid bathroom units of modular construction that may be readily assembled in an existing room convenient to the invalid.

Many invalids or handicapped, and particularly the elderly, have a physical problem that prevents them from going up and down stairs, and they therefore have need for the provision of toilet and shower facilities on a first floor level on a home which does not have such facilities on the first floor.

It is an object of the present invention to provide a prefabricated and preplumbed modular invalid bathroom unit which has wheelchair access for installation in a first floor room for the invalid. The unit may be readily assembled in a first floor room and disassembled and removed when no longer needed.

A number of such prefabricated units have been previously designed, however they have considerable shortcomings in that they are not designed in modular sections which can readily pass through a common door opening of a house or dwelling and they do not efficiently and practically provide preplumbed capabilities and ease of assembly and disassembly.

SUMMARY OF THE INVENTION

The prefabricated modular invalid bathroom unit of the present invention is designed for easy installation and practical use in an existing room. The bathroom unit includes a shower seat portion having a shower seat, a shower floor portion adjacent this shower seat for draining shower water, an upper shower wall portion that is detachably mounted on the shower seat portion opposite the shower floor as a back splash surround, and a commode portion that is adapted to receive a water closet and which mates or joins with the shower floor portion opposite the shower seat. The shower floor portion is sized and adapted for wheelchair access and additionally provides wheelchair access to the shower seat and the commode portion.

The unit sections or portions are preplumbed and provided with supply pipes for supplying water to the shower seat and commode portions from common hot and cold water supply lines and drain pipes connected for draining the shower floor portion and the commode portion to a common drain line. The supply and drain pipes are connected together as required between modular portions with conventional plumbing connectors, couplers and fittings, which are all carried by the bathroom unit when assembled.

The shower seat portion and commode portion are designed to have a height which is sufficiently short to pass through a standard door opening in a dwelling, which is typically 30" to 32". This permits easy access of the unassembled unit into the home for subsequent assembly.

The shower seat portion and the shower floor portion may be unitarily molded as one structure, if desired. These bathroom unit portions are preferably molded plastic or fiberglass segments or sections that are adapted to be assembled together to provide the bathroom unit.

Another feature of the present invention is the provision of a combination foundation seat and template that is adapted to be secured to a room floor for receiving and retaining the assembled bathroom unit thereon. The foundation seat has a plumbing template therein adapted for prelocating all plumbing access holes which must be provided in the underlying room floor for the bathroom unit to be assembled. Access panels may also be provided in portions of the bathroom unit for easy plumbing access to the pipes.

Venting of the drain pipes is conveniently provided by the inclusion of a loop vent for ventilating the drain pipes. The loop vent may be extended downwardly through the underlying floor beside the drain pipe and then to the building exterior.

The shower seat is sloped to drain water onto the shower floor and a number of different types of shower heads may be provided in the shower seat portion for showering. A shower head may be provided in the back of the shower wall portion and adapted to direct shower water to the back of a seated person. In another embodiment, or in an addition to the back shower head, a portable shower head with a flexible water supply line may be provided in the shower seat portion for showering.

The shower seat is preferably provided with a seat access thereunder that is adapted for accessing the underside of a seated person for bathing. This seat access opens toward the shower floor for appropriate draining thereto. This seat recessed may also include a directionally adjustable shower bidet nozzle.

A diverter valve may be provided in the shower portion to direct shower water to any one of the provided shower heads.

The invalid bathroom unit of the present invention may also be provided with a wash basin which is built into either the shower seat portion or the commode portion of the unit. This basin is provided with a hot and cold water mixer valve and a faucet connected to the valves and of course the basin is provided with a water drain in the bottom thereof. The mixer valve and the wash basin drains are connected as required to the other pipes in the unit for respective water supply and drainage.

This wash basin includes a diverter valve that is adapted for diverting a hot and cold water mixture from the mixer valve to a valve mounted in the shower seat portion of the bathroom unit for at least one shower head that is provided in the shower portion as previously described. This arrangement permits pretesting of the shower water temperature in the basin before the water as mixed is diverted to the shower seat portion for showering, thereby ensuring that the water is at the proper temperature for bathing and further ensuring that the person being cared for is not scalded. The shower seat portion includes, as previously described, preferably multiple shower heads and a diverter valve for selecting activation of the shower heads as supplied from the basin mixer valve.

The commode portion of the bathroom unit includes a water closet mounting shelf which will accept and raise a standard water closet relative to the shower floor portion to thereby position the toilet seat of a standard water closet on the shelf at a greater height that is more convenient for an invalid. This commode seat height is generally referred to in the industry as standard invalid height.

The shower floor portion is also preferably raised from the room floor in order to provide pipe access thereunder and a ramp is positioned adjacent the shower floor portion for wheelchair access to the shower floor. Additional wheelchair access may also be provided for this shower floor and positioned opposite the aforedescribed wheelchair ramp access. This permits access from both sides of the shower floor in order to more easily manipulate the person or patient for positioning the person as required in the bathroom unit for showering or for toilet use.

An electric fan ventilation system may also be mounted in the commode portion of the bathroom unit to provide ventilation. In addition, invalid grab bars may also be mounted in the shower seat portion and in the commode portion as required to assist the invalid in maneuvering about the bathroom unit.

BRIEF DESCRIPTION OF THE DRAWINGS

Other objects and advantages appear in the following description and claims. The accompanying drawings show, for the purpose of exemplification, without limiting the invention or the appended claims, certain practical embodiments of the invention wherein:

Referring to FIGS. 1, 2 and 3, the prefabricated modular invalid bathroom unit 10 of the present invention is made up of a number of modular sections or portions. A shower seat portion 11 having a shower seat 14, a shower floor portion 12 which is adjacent shower seat portion 11 for draining shower water through the use of water floor drain 13 are provided. The floor portion 12 is sized and adapted for wheelchair access via open wheelchair access door 14 and up ramp or wheelchair ramp 15.

An upper shower wall portion 16 is mounted on top of shower seat portion 11 opposite the shower floor portion 12 to provide a back splash surround for the shower when the person being showered is seated on shower seat 14.

Figure 3:
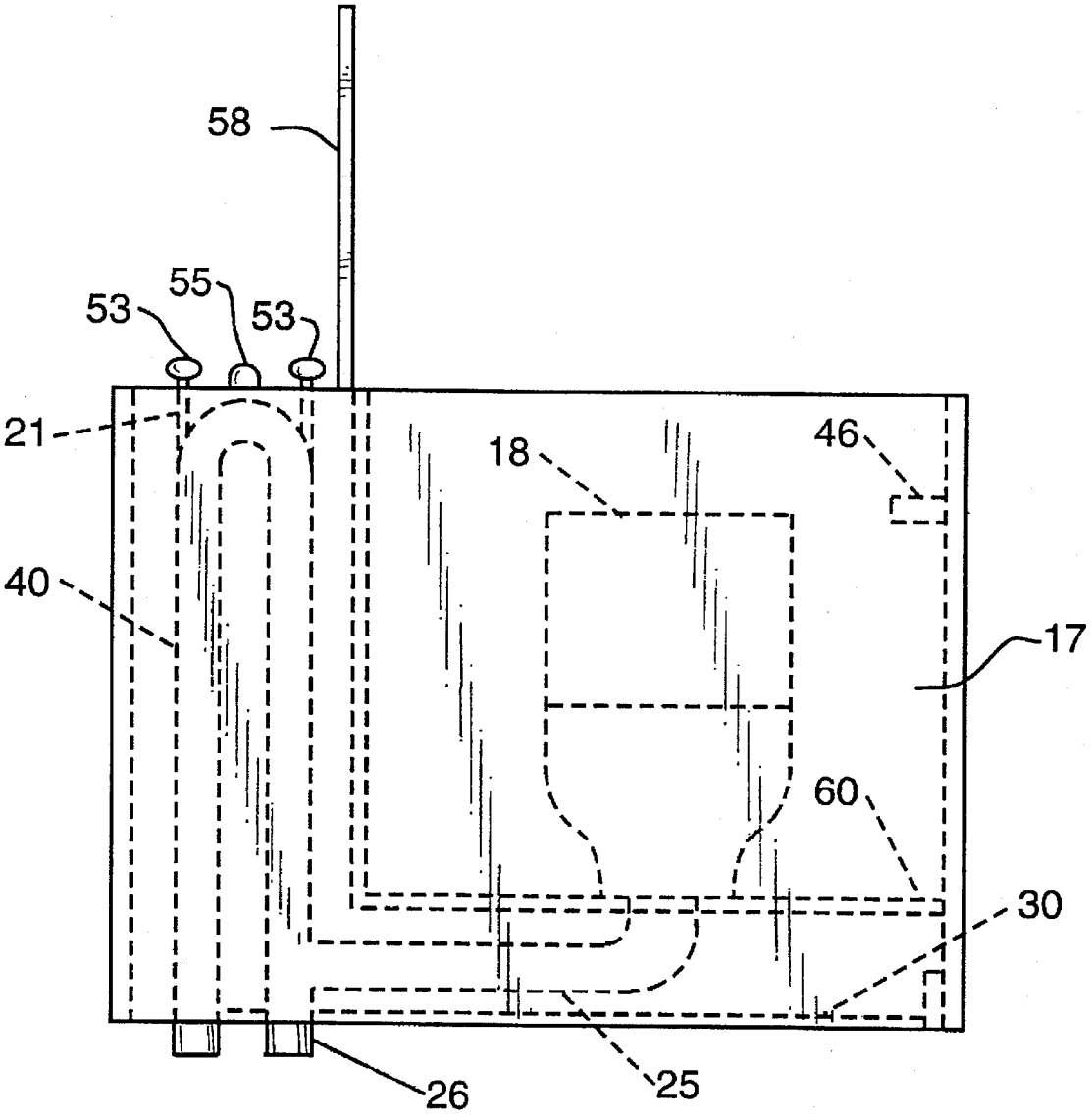
FIG. 3 is a right end view in elevation of the prefabricated modular invalid bathroom unit shown in FIGS. 1 and 2.

Lastly, a commode module portion 17, which is adapted to receive a water closet as illustrated in dashed outline 18 in FIG. 3, mates with shower floor portion 12 opposite shower seat portion 11 for wheelchair access from the shower floor portion 12.

Water supply pipes 20 are carried by the respective modular sections or portions and are connected together for supplying water to the shower seat and commode portions from common hot and cold water supply lines 21 and 22, which emanate or emerge from an underlying floor through openings which must be provided as hereinafter described.

In a similar manner, drain pipes 25 are carried by each respective modular portion of the bathroom unit and are connected together between respective units for draining the shower floor portion 12 and to drain commode portion 17 to a common drain line 26. The supply and drain pipes are connected together between modular sections or portions of the bathroom unit with conventional plumbing connectors, couplers and fittings, which are all carried by the bathroom unit 10 when entirely assembled. Conventional compression couplings may be used for connecting water supply pipes between adjacent bathroom unit modular sections or portions and flexible drain couplings, for example was manufactured under the trademark FERNCO, may be used for coupling drain pipes together between adjacent sections.

Figure 1:
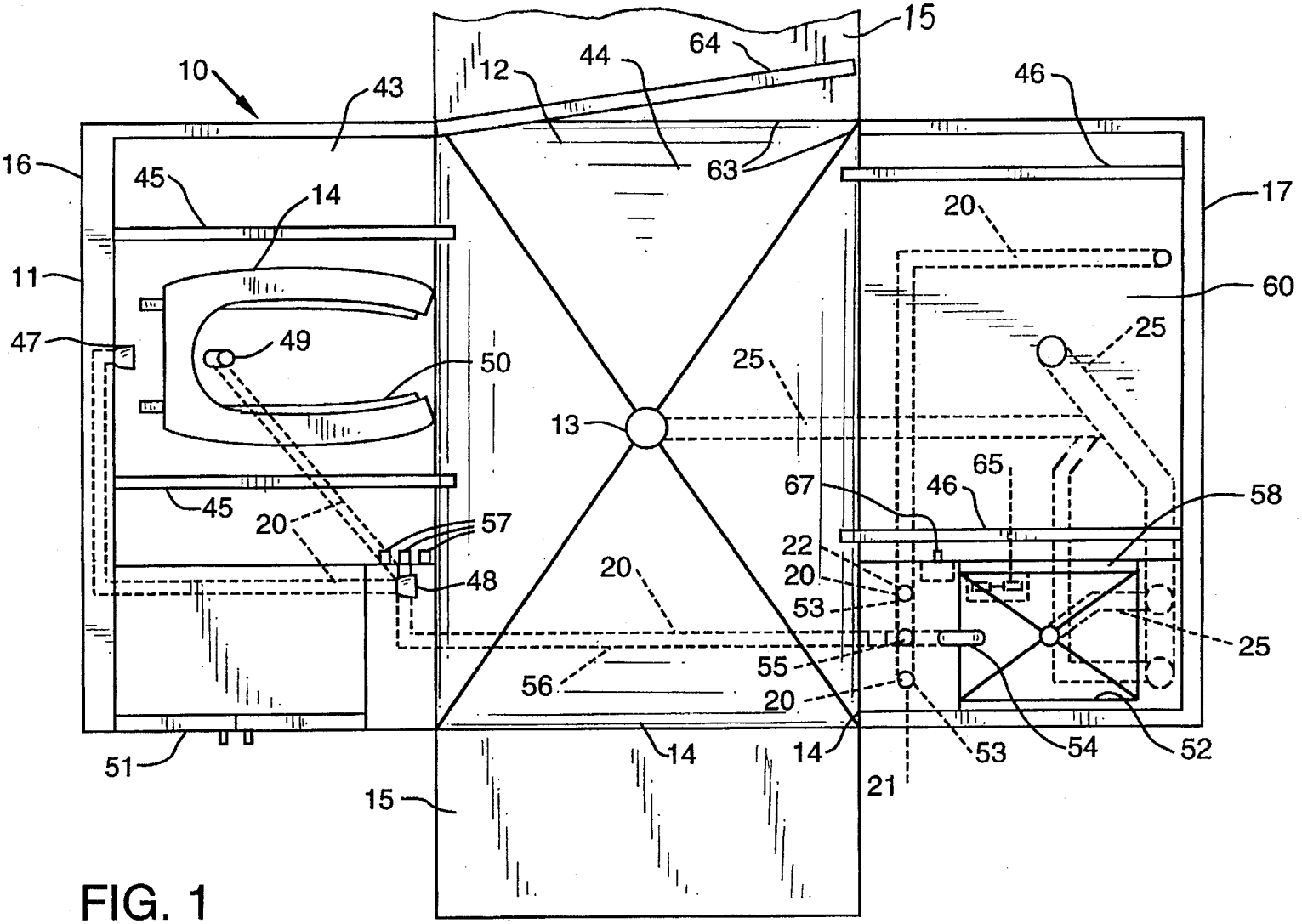
FIG. 1 is a plan view of one embodiment of the prefabricated modular invalid bathroom unit of the present invention.
Figure 2:
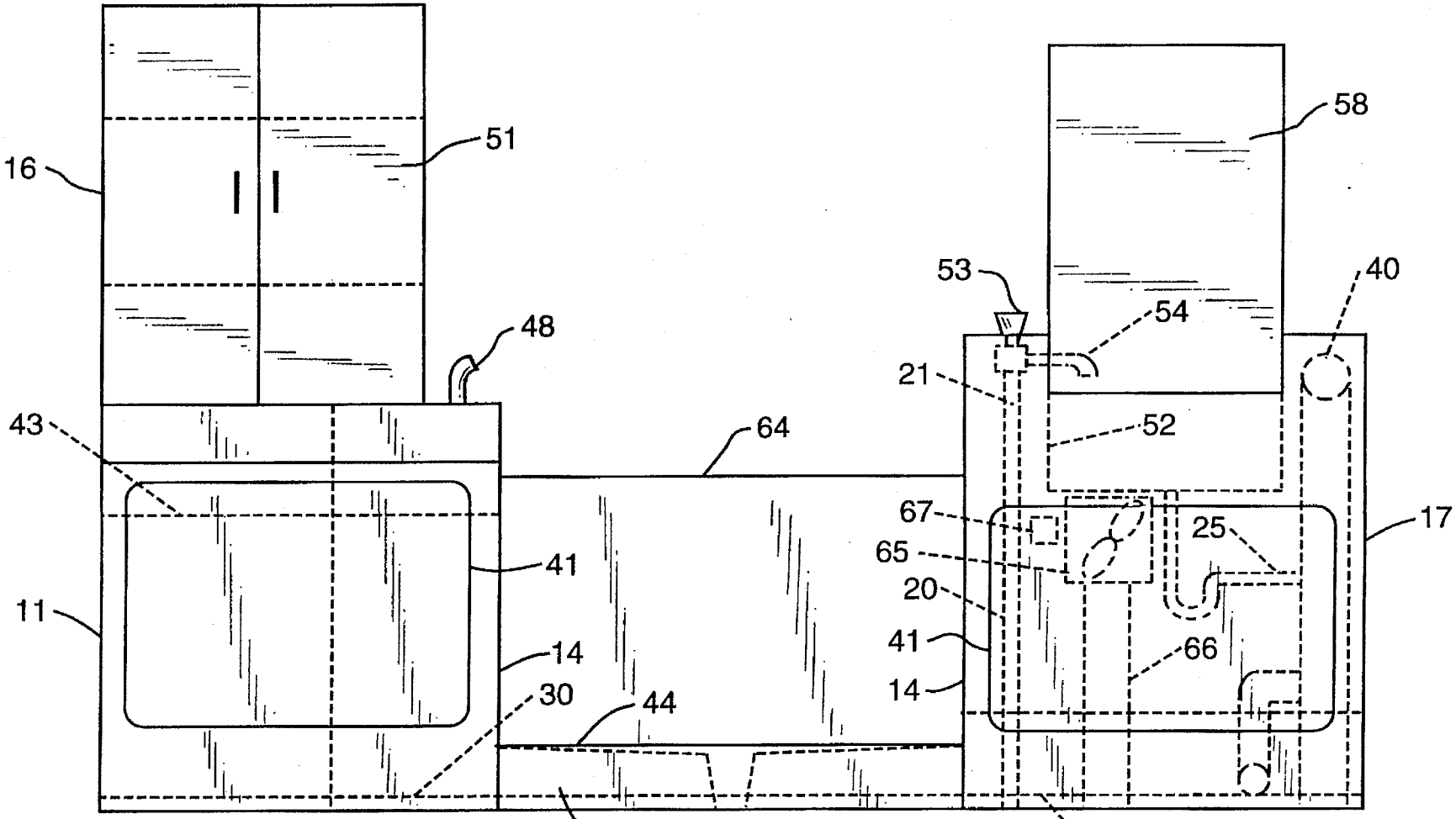
FIG. 2 is a view in front elevation of the prefabricated modular invalid bathroom unit shown in FIG. 1.

In the prefabricated modular invalid-bathroom unit 10 illustrated in FIGS. 1, 2 and 3, the shower seat portion 11 and the shower floor portion 12 are unitary and are molded together as one unit of plastic or fiberglass, or any suitable material which is presently used, for example, for the manufacture and molding of present day shower and bathtub surrounds found on the market.

The combined shower seat portion and shower floor portion 11–12, and the commode portion 17 are provided with a height which is sufficiently short so that these units will respectively easily pass sideways through a standard door opening, which is typically 30" or 32".

In this manner the module portions may be easily brought into the invalid's bedroom or other first floor room for easy assembly.

The shower back surround 16 is detachable to the top of shower seat portion 11 and therefore does not hinder ingress and egress of the shower seat portion 11 through doorways into and out of the home and rooms within the home.

Figure 4:
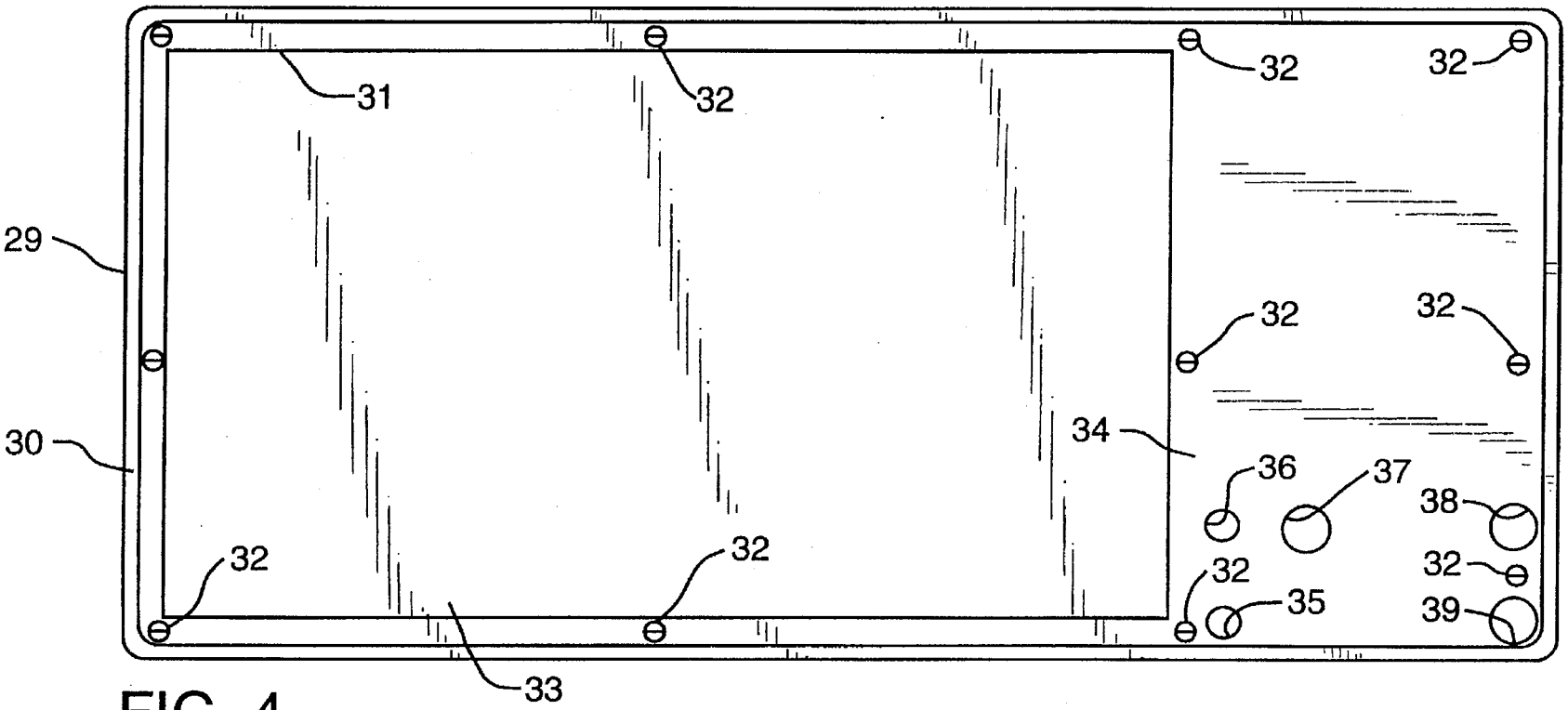
FIG. 4 is a plan view of a combination foundation seat and plumbing template which is adapted for receiving the assembled bathroom unit shown in FIGS. 1, 2 and 3 and for also providing a plumbing template adapted for prelocating all plumbing access holes which must be provided in an underlying room floor for the bathroom unit prior to assembly.
Figure 5:
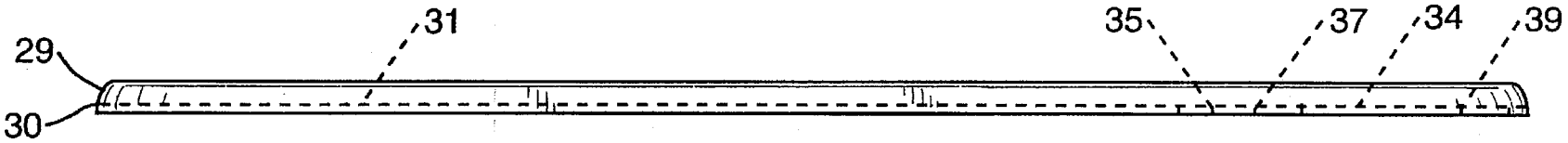
FIG. 5 is a view in front elevation of the combination foundation seat and plumbing template shown in FIG. 4.

In order to more readily adapt the bathroom unit for assembly within the room where it is to be assembled in the home, a combination foundation seat and plumbing template 30, as best seen in FIGS. 4 and 5, is provided. This combination foundation seat and template can be easily secured to a room floor with wood screws which pass through plastic flange 31 of the foundation template 30 as respectively indicated at 32, into the underlying floor 33.

The template portion 34 of flange 31 is provided with template holes therethrough for prelocating all plumbing access (and electric) holes which must be provided in the underlying room floor 33 for the bathroom unit prior to assembly.

For example, the template holes 35 and 36 indicate respectively in flange template portion 34 the location of the hot and cold water supply pipe lines which must come up from under the floor at this location. Template hole or opening 37 is provided for a fan ventilation pipe, template hole 38 is provided for the sewer drain or drain pipe 26 and template hole 39 is provided for the loop vent pipe 40, which is indicated best in FIG. 3, which provides the appropriate ventilation for the drain pipes 25.

Once the combination foundation seat and template 30 has been secured to the underlying floor 33, then it is very easy for the plumber to cut out the appropriate sized openings in the template plate 34 to provide the proper access from the basement or room beneath for plumbing supply and drain lines.

With particular reference to FIG. 2, external side access panels 41 are provided in the shower seat portion and also in the commode seat portion to provide appropriate plumbing access to the pipes enclosed therein for plumbing connections or disconnections. These access panels are secured in place by any conventional means, such as velcro strips, screws or the like.

The shower seat portion 11 is also provided with a sloped seat surface 43 which is sloped to drain water to the shower floor 44 of shower floor portion 12. In addition, appropriate grab rails 45 are provided in the shower seat portion for grasping by the patient or person being bathed. In a similar fashion, grab rails 46 are provided in the commode portion 17.

Three different shower heads are provided in the shower seat portion. One shower head 47 is adapted to directing shower water to the back of a person seated on seat 14. A second shower head 48 is a portable shower head with a flexible water supply line that is provided to be portably moved to any area within shower portion 11 for bathing. The third shower head 49 is provided in the seat recess 50 as a bidet shower head nozzle which is directionally adjustable for assisting in bathing the underside of a seated person.

A wash basin 52 is shown as being provided in the commode portion 17. Of course the basin could just as easily be constructed as a portion of the shower seat portion 11. Wash basin 52 is provided with a hot and cold water mixer valve or valves 53 and a common spigot 54. Basin 52 is additionally provided with a diverter valve 55 which is adapted for diverting a hot and cold water mixture from mixer valve 55 through pipe 56 to a diverter or selection valve 57 in shower seat portion 11. By selecting the proper position for diverter valve 57 in shower seat portion 11, the mixed hot and cold water combination can be selectively directed to any one or more of the three shower heads 47, 48 or 49. In addition, this combination most importantly permits pretesting of shower water temperature in basin 52 from spigot 54 before it is diverted with valve 55 to the shower seat portion. This prevents the patient from being scalded with hot water and permits the attendant to first test the water mixture for appropriate bathing temperature before it is diverted to any of the shower heads in shower seat portion 11.

Shower floor 44 is raised off of floor 33 to permit passage of water supply pipes and drain pipes.

Commode modular portion 17 includes a water closet mounting shelf 60 which is provided at an appropriate height whereby it raises a standard water closet, as illustrated in dashed outline in FIG. 3 at 18, relative to the shower floor portion to position the toilet seat of such a standard water closet at a higher height which is more convenient for an invalid. This height is generally referred to as invalid height and is set by plumbing code in many states or cities for invalids.

An additional wheelchair access opening 63 and wheel chair ramp 15 is provided for access to the shower floor 44 from the opposite side of ramped access 14 and 15. A low shower door 64 is provided to assist in preventing the splashing of water out onto the nearby floor.

A ventilation fan 65 is also provided in the commode portion to provide proper ventilation. This is a conventional electric fan which is ventilated through a vent pipe 66 downwardly through the underlying floor 33 to an appropriate exit point. An electrical wire is also brought up through the floor 33 along with the pipe for energizing the electric fan from electrical switch 67. This same wire (not shown) can also be used for appropriate lighting.

The shower back surround is also conveniently provided with a linen closet 51, and the basin 52 is provided with a mirror 58 slidably received in a pocket in the basin top.

The combination foundation seat and template 30 is provided with a perimeter base lip 29 which acts as a foundation guide over which the entire assembled bathroom unit 11 is guidably received. It seats perimetrically around this entire foundation lip 29 and, if desired, screws (not shown) may be screwed through the outer bottom edge wall of the unit 11 into this perimetral foundation lip 29 to assist in making sure that the assembled bathroom unit 11 does not or cannot move from its foundation.

The prefabricated modular invalid bathroom unit of the present invention can generally be readily installed by a knowledgeable plumber in a patient's room within a day or two and disassembled easily within a day for removal.

As previously explained, the unit is not only very efficient for assembly and disassembly, but it is very readily adapted for ingress and egress from a house through standard doors.

The prefabricated modular bathroom unit of the present invention provides the possibility of the invalid's loved ones being able to care for the invalid at home for greater periods of time which would not otherwise be possible except for the this facility, thereby saving considerable amounts of nursing care, and in turn possibly saving the state considerable amounts of assistance money.

I claim:

1. A prefabricated modular invalid bathroom unit for installation in a room, said unit comprising: a shower seat portion having a shower seat; a shower floor portion adjacent said shower seat portion for draining shower water therefrom and having a water floor drain, said floor portion sized and adapted for wheelchair access; an upper shower wall portion detachably mounted on said shower seat portion opposite said shower floor portion as a back splash surround; a commode portion adapted to receive a water closet and joinable with said shower floor portion opposite said shower seat portion for wheelchair access from said shower floor portion; supply pipes connected for supplying water to said shower seat and commode portions from common hot and cold water supply lines, and drain pipes connected for draining said shower floor portion and said commode portion to a common drain line, said supply and drain pipes together with required plumbing connectors, couplers and fittings therefor carried by said bathroom unit when assembled.

2. The prefabricated modular invalid bathroom unit of claim 1, wherein said shower seat portion and said commode portion have a height sufficiently short to pass through a standard door opening width.

3. The prefabricated modular invalid bathroom unit of claim 2, wherein said shower seat portion and said shower floor portion are unitary.

4. The prefabricated modular invalid bathroom unit of claim 3, wherein said portions are molded plastic segments adapted to be assembled together to provide said bathroom unit.

5. The prefabricated modular invalid bathroom unit of claim 4, including a combination foundation seat and template adapted to be secured to a room floor for receiving and retaining said assembled bathroom unit thereon and having a plumbing template therein adapted for prelocating all plumbing access holes which must be provided in an underlying room floor for said bathroom unit prior to assembly.

6. The prefabricated modular invalid bathroom unit of claim 4, including external access panels provided in said portions for plumbing access to said pipes.

7. The prefabricated modular invalid bathroom unit of claim 1, said drain pipes including a loop vent for ventilating said drain pipes.

8. The prefabricated modular invalid bathroom unit of claim wherein said shower seat is sloped to drain water to said shower floor.

9. The prefabricated modular invalid bathroom unit of claim 8, including a shower head provided in said shower portion and adapted to direct shower water on to the back of a seated person.

10. The prefabricated modular invalid bathroom unit of claim 8, including a portable shower head with a flexible water supply line provided in said shower seat portion for showering.

11. The prefabricated modular invalid bathroom unit of claim 8, wherein said shower seat includes a seat recess adapted for accessing an underside of seated person for bathing, said seat recess open toward said shower floor and adapted for draining thereto.

12. The prefabricated modular invalid bathroom unit of claim 11, said seat recess including a directionally adjustable shower bidet nozzle.

13. The prefabricated modular invalid bathroom unit of claim 1, including a wash basin built into one of said shower seat portion and commode portion and provided with hot and cold water mixer valve means and a faucet connected to said valve means and a drain, said mixer valve means and said wash basin drain connected to said pipes for respective water supply and drainage.

14. The prefabricated modular invalid bathroom unit of claim 13, said wash basin including a diverter valve adapted for diverting a hot and cold water mixture from said mixer valve to a valve mounted in said shower seat portion for at least one shower head provided in said shower seat portion thereby permitting pretesting of shower water temperature in said basin before showering in said shower seat portion.

15. The prefabricated modular invalid bathroom unit of claim 14, said shower seat portion including more than one shower head and a diverting valve for selecting activation of said shower heads from said mixer valve.

16. The prefabricated modular invalid bathroom unit of claim 15, including three of said shower heads wherein one is a portable shower head with a flexible line, a second is a back shower head mounted on said upper shower wall portion, and a third is mounted in a seat recess as for said shower seat a bidet shower head.

17. The prefabricated modular invalid bathroom unit of claim 1, wherein said commode portion includes a water closet mounting shelf which is at a higher elevation than said shower floor portion to thereby position a toilet seat on a standard water closet mounted on said shelf at a greater height which is more convenient for an invalid.

18. The prefabricated modular invalid bathroom unit of claim 1, wherein said shower floor portion has a raised drain floor for pipe access thereunder, and a ramp positioned for wheelchair access to said floor.

19. The prefabricated modular invalid bathroom unit of claim 18, including an additional wheelchair access for said shower floor and positioned opposite said ramped access.

20. The prefabricated modular invalid bathroom unit of claim 19, including an additional wheelchair access ramp positioned for wheelchair access to said additional shower floor access.

21. The prefabricated modular invalid bathroom unit of claim including an electric fan ventilation system mounted in said commode portion.

22. The prefabricated modular invalid bathroom unit of claim 1, including invalid bathroom unit of claim 1, including invalid grab bars mounted in said shower seat portion and said commode portion.

* * * * *